United States Patent [19]

Tischer et al.

[11] 4,316,931

[45] Feb. 23, 1982

[54] PLANAR TEXTILE STRUCTURE WITH IMPROVED HEAT RETENTION

[75] Inventors: Kurt Tischer, Hemsbach; Bohuslav Tecl; Walter Föttinger, both of Weinheim, all of Fed. Rep. of Germany

[73] Assignee: Firma Carl Freudenberg, Weinheim, Fed. Rep. of Germany

[21] Appl. No.: 124,334

[22] Filed: Feb. 25, 1980

[30] Foreign Application Priority Data

Apr. 11, 1979 [DE] Fed. Rep. of Germany ..... 2914616
Apr. 11, 1979 [DE] Fed. Rep. of Germany ... 7910585[U]

[51] Int. Cl.[3] ..... B05D 3/02; B05D 5/00; B32B 27/34; D04H 1/58

[52] U.S. Cl. ..... 428/267; 260/37 SB; 260/39 M; 260/42.22; 427/288; 427/316; 427/389.9; 428/288; 428/290

[58] Field of Search ..... 427/288, 389.9, 316; 428/245, 290, 265, 267, 288; 260/37 SB, 39 M, 42.22

[56] References Cited

U.S. PATENT DOCUMENTS 2,079,629 5/1937 Platt ..... 427/288
2,695,895 11/1954 Barnard et al. ..... 260/42.22 X

*Primary Examiner*—Michael R. Lusignan
*Attorney, Agent, or Firm*—Kenyon & Kenyon

[57] ABSTRACT

A method for improving the heat retention of a planar textile structure by coating at least one surface of the structure with a dispersion of liquid carrier, cross-linkable binder and metallic powder, and then cross-linking the binder and removing the liquid carrier from the coating.

6 Claims, No Drawings

PLANAR TEXTILE STRUCTURE WITH IMPROVED HEAT RETENTION

BACKGROUND OF THE INVENTION

The present invention relates to a planar or areal textile structure with improved heat retention which is to be applied as clothing material or in other applications where a dry, warm micro climate is to be achieved or maintained at the skin surface of the human body. Heat retention is, in the context of this invention, to be considered as representative of all other physiological properties of the respective planar textile structure. These are substantially influenced by the moisture passage resistance of the material.

The heat retention of a planar textile structure generally increases with increasing thickness. In parallel with increasing thickness, the resistance to the passage of moisture also increases, with the result that textiles considered in themselves as warming can cause the skin to be covered with uncomfortable perspiration after they have been worn for a short time. The thickness of the planar textile structures is, therefore chosen so that at a given nominal temperature, satisfactory removal of the moisture formed is ensured in addition to adequate heat retention. The compromise thus arrived at leads to difficulties if the outside ambient temperature deviates distinctly from the noted nominal temperature. In this context, it can be assumed that a feeling of comfort is generally provided only if the average skin temperature does not fall below 32° C., with isolated deviations of ±4° C. being allowed in the vicinity of certain zones. The perspiration coverage of the skin surface must, in addition, be less than 30% if a feeling of comfort is to be provided.

SUMMARY OF THE INVENTION

It is an object of the present invention to develop a planar textile structure which exhibits a substantial improvement in its thermal insulating properties without appreciably impairing its moisture permeability. It should then be possible to use relatively thin and lightweight planar textile structures in applications which have heretofore been reserved for heavy-weight, thick planar textile structures.

To solve this problem, the present invention provides a planar structure which is made by applying to at least one surface of a conventionally made planar textile structure a dispersion of: (1) a binder which is capable of being subsequently crosslinked and (2) from about 10 to 50% by weight, referred to the solids content of the dispersion, which itself is maximally 50 weight percent, of a metallic powder with a grain size between 3 and 90 μm. The grain size of the metallic powder is, for the purpose of this invention, that determined according to the method of DIN 4190.

Application of the binder dispersion to the planar textile structure results in only very insignificant changes in the existing porosity and the textile properties. The metal powder contained in the porous layer of binder arranged on the fibers facing the coated side is covered on the surface by at least a very thin skin of the elastomeric material of the binder. Through appropriate choice of the material, the film thickness and the coloring, no appreciable changes from the original, untreated planar textile structures need occur with respect to external appearance and feel of the textile. Even so, substantially improved thermal insulation properties are obtained.

The planar structure according to the invention, in ensuring definite thermal insulating properties, can be made substantially thinner than conventional materials. With a lower weight per unit area, it has substantially improved moisture transport behavior, and its processing makes possible optimum wearing comfort, especially in the manufacture of sports clothes.

It is also possible to improve the thermal insulating properties to match sufficient moisture passage resistance. From such a match there results optimum thermal insulation, which makes possible the use of corresponding planar structures, for example, for the manufacture of sleeping bags for extreme climatic conditions. In addition, the actual weight per unit area of the fully treated planar textile structure is, in this case, substantially below that of comparable known materials.

Treatment of the planar textile structure with the binder dispersion results in an additional reinforcement effect which has advantages with respect to wear durability, chemical cleaning and in washing. For this reason, materials treated according to this invention can be considered extremely rugged in spite of their small thickness of preferably 0.4 to 2 mm, as compared to untreated planar textile structures of the same type.

With regard to the drapability and feel of the textile, a slight impairment as compared to the original material is noted, although in most cases, this impairment is quite insignificant. It can be corrected or eliminated by printing the binder dispersion in a discontinuous pattern on the planar textile structure. However, in order to avoid a stiffening effect, it is advantageous to use a geometrical pattern without any preferred directional orientation. Such a pattern may be composed, for example, of individual areas, the center distances of which change continuously according to a rectangle function within the range of definite limits. In the case of a circular image, the individual areas may have, for example, a diamater of 0.5 mm with a mutual spacing of 1.0 mm±0.2 mm.

The printing process as such can be carried out in accordance with various methods, for example, by means of silk screen printing or gravure printing. It is equally possible to wipe or spray the binder dispersion onto the surface of the planar textile structure. In the last mentioned case, a statistical distribution of the individual binder droplets is obtained. In addition to a scattering of the mutual distance of the individual droplets from each other, a spread in the size of the area covered by the individual droplets is then obtained.

The metallic powders that can be used in the present invention consist preferably of aluminum or aluminum alloys. Heavy-metal powders, for example, such as brass or copper, can also be used. In these cases, however, the viscosity of the binder dispersion used must be adjusted somewhat higher in order to prevent sedimentation processes during or after application to the planar textile structure.

In the finished coating substance, the metallic powder functions to reflect the highest possible percentage of the incident heat radiation, so as to prevent thereby a transfer to the surface of the treated material. With regard to the wearing comfort achieved, it is obviously of considerable importance that the incident heat be prevented, as far as possible, from being passed on within the plane of the planar textile structure. The surface temperature of the skin, which is generally different on different parts of the body, is, therefore, not equalized within the plane of the material. A particularly high or low temperature level in certain zones is therefore preserved, which is perceived as pleasant and agreeable. This feature, which results from the application of the invention, also is found to be advantageous in the practical application and use of the materials treated accordingly.

The method used can be applied in the treatment of woven fabrics as well as nonwoven fabrics, for example, in the treatment of knitted or spun-bonded materials. In cases where direct treatment of an outer material is not desired, it is also possible to treat an insert or padding of the spun-bonded (fleece) fabric type according to the invention, and to join it subsequently to the outer material, for example, by sewing or cementing. In the last-mentioned case, the insert or padding material treated according to the invention is therefore processed as in known fixation inserts. The changes of the textile properties of the outer material correspond to those which are known from known fixation inserts. The outer materials can, for example, be given a directional stiffening force and, in certain portions, a soft, textile-like fall. Fashion-dictated accents can, therefore, be taken into consideration to a large extent when the present invention is employed.

On the other hand, it is also possible to treat a lining material in accordance with the invention. It is also possible, in making a piece of clothing such as an anorak, to treat the lining material and the padding in accordance with the invention and thereby enhance the effect.

The invention can be carried out, in principle, utilizing all known binders that can be dispersed, for example, acrylic acid ester polymerizates, butadiene-acrylonitrile polymerizates, butadiene-styrene polymerizates, polysiloxanes, formaldehyde condensation products or their mixtures, as well as others. So as not to impair the pore structure of the film formed, it has been found advantageous to use, as far as possible, binders which can coagulate at low temperatures. Such an effect can be achieved by the addition of a heat sensitizing agent or by using a binder which is polymerized by the action of light. The cross-linking is then advantageously accomplished immediately after the application to the planar textile structure, and only then is the carrier liquid removed in the usual way, for example, by suction and/or drying.

DETAILED DESCRIPTION OF THE INVENTION

Additional details regarding the present invention are illustrated in the following example.

EXAMPLE

A soft random fleece of

| | |
|---|---|
| 15 parts Heterofil fibers | dtex 3.3/40 semi-matte |
| 35 parts nylon | dtex 3.3/60 matte |
| 30 parts nylon | dtex 3.3/51 matte |
| 20 parts diolene | dtex 3.3/60 matte |

with a weight of about 40 g/m$^2$ is thermally pre-solidified in the known manner and then printed by means of a 25-mesh printing foil, hole diameter 0.5 mm, wall thickness 0.22 mm and a coverage of 40 g/m$^2$, with a printing paste consisting of

| | |
|---|---|
| Al-powder (average particle size 25 μm) | 100 parts by weight |
| Polyacrylate dispersion | 150 |
| Polybutadiene dispersion | 150 |
| Melamine resin | 60 |
| Polyvinyl alcohol | 30 |
| Diethylene alcohol | 50 |
| Diammonium phosphate | 1.5 |
| Antifoam dispersion | 30 |
| Water | 630.7 |
| | 1194.2 |

(Solids content of the printing mixture, 30%)

and is then dried.

The fleece material treated in the method described above was sewed into the right breast half of a wind breaker jacket under the outer material. A fleece material treated with the same binder dispersion but without metal powder content was sewed into the left breast half of the same wind breaker jacket in the same manner. The wind breaker jacket was put on a test person who was at rest in a room with a temperature of 20° C. After 10 minutes, a photograph of the breast portion was taken with an infrared thermo camera "Thermographic Imager, Model 800." By means of this picture, it could be demonstrated that the average surface temperature of the breast half provied with the insert material according to the invention was 1.5° to 2° C. lower than that of the opposite side. With the same moisture passage resistance, a substantially improved thermal insulation effect was, therefore, obtained.

In order to eliminate any possible influence of a characteristic of the test person being responsible for the result of the measurement, the test was subsequently repeated but with the wind breaker jacket equipped in the opposite manner. The result described above was confirmed by the infrared picture obtained.

What is claimed is:

1. A method for improving the heat retention of a planar textile structure comprising:

(a) applying to at least one surface of said structure a dispersion comprised of:

(i) a carrier liquid;

(ii) a binder material capable of being cross-linked; and (iii) 10 to 50% by weight, based on the solids content of the dispersion, of a metallic powder having an average grain size between 3 and 90 μm, the solids content of said dispersion being no greater than 50% by weight;

(b) immediately thereafter subjecting said applied dispersion to conditions effective to cross-link and solidify said binder prior to the complete removal of the carrier liquid from the dispersion; and (c) thereafter removing any remaining carrier liquid from the structure, whereby said metallic powder is arranged on the fibers of the textile structure in a porous layer of the cross-linked binder and is covered on the surface thereof by a thin skin of the cross-linked binder material.

2. The method according to claim 1 wherein said binder dispersion is applied to the structure by printing the dispersion on the structure in a pattern fashion.

3. The method according to claim 1 wherein said metallic powder comprises aluminum.

4. The method according to claim 1 wherein said planar textile structure comprises an inner padding for insertion in a garment.

5. A planar textile structure with improved heat retention made according to the process of claim 1.

6. A planar textile structure with improved heat retention made according to the process of claims 2 or 3.

* * * * *